United States Patent [19]

Domingo

[11] Patent Number: 4,834,331

[45] Date of Patent: May 30, 1989

[54] HOLDING DEVICE

[75] Inventor: Ricardo Domingo, Barcelona, Spain

[73] Assignee: Sitour Espana, S.A., Barcelona, Spain

[21] Appl. No.: 880,892

[22] Filed: Jul. 1, 1986

[30] Foreign Application Priority Data

Jul. 3, 1985 [ES] Spain ..... 288122

[51] Int. Cl.[4] ..... A47H 1/10

[52] U.S. Cl. ..... 248/205.3; 242/129.6; 242/129.8; 248/329

[58] Field of Search ..... 248/205.3, 329, 330.1, 248/328; 242/129.6, 129.8

[56] References Cited

U.S. PATENT DOCUMENTS

| | | | |
|---|---|---|---|
| 279,919 | 6/1883 | Cornely | 242/129.6 |
| 1,112,692 | 10/1914 | Fraser | 242/129.6 |
| 1,126,074 | 1/1915 | Pitel | 248/330.1 |
| 1,182,523 | 5/1916 | Benson | 242/129.6 |
| 1,243,039 | 10/1917 | Carroll et al. | 248/330.1 X |
| 2,439,238 | 4/1948 | Collins | 248/330.1 |
| 4,073,458 | 2/1978 | Sease . | |
| 4,279,389 | 7/1981 | Thomas | 242/129.8 X |
| 4,323,206 | 4/1982 | Dickey | 242/129.8 X |
| 4,360,172 | 11/1982 | Cope | 242/129.8 |
| 4,392,316 | 7/1983 | Thomas . | |
| 4,434,570 | 3/1984 | Roos . | |

FOREIGN PATENT DOCUMENTS

| | | | |
|---|---|---|---|
| 119964 | 9/1900 | Fed. Rep. of Germany | 242/129.6 |
| 2529202 | 1/1977 | Fed. Rep. of Germany . | |
| 1325117 | 8/1973 | United Kingdom | 248/205.3 |
| 1486901 | 9/1977 | United Kingdom . | |

*Primary Examiner*—J. Franklin Foss
*Assistant Examiner*—David L. Talbott
*Attorney, Agent, or Firm*—Herbert Dubno

[57] ABSTRACT

A holding device in which a plate is provided with two extreme perpendicular wings with resilient tendency to close to each other, laying between both these wings a shaft with stems to mounting the same under pressure to respective holes formed in the wings and large heads to obtain a friction effect on the inner face of the wings, which effect can be increased by means of corrugations or ribs formed in the said face, bearing the shaft a winding thread from which the mobile hangs to the desired height, being the plate on its rear side provided with an adhesive layer for fitting the device to the ceiling from which the advertising mobile is designed to hang.

2 Claims, 1 Drawing Sheet

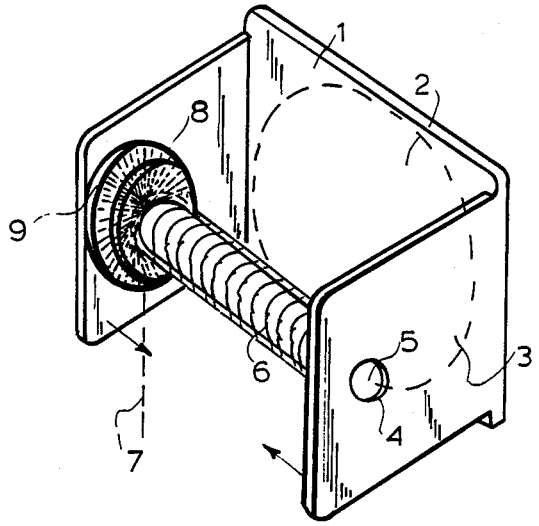
1
2
8
9
5
3
6
4
7

HOLDING DEVICE

FIELD OF THE INVENTION

The present invention concerns to a holding device for holding and fitting of hanging elements (mobiles) to the height of the ceilings for publicity sales locations, the said device being characterized by its simplicity, functional versatility and low cost, as well as by the efficacy of the obtained effects, i.e. to fit to the suitable height an advertising mobile and to hold the latter in place without changes as to the previously chosen height.

BACKGROUND OF THE INVENTION

There are presently a variety of holding and fitting means for hanging elements designed for advertising purposes at the point of sale, generally formed by springs or the like, but these elements not only weaken the structure of the device, but also cannot avoid cases involving considerable changes in the height considered as the most convenient for the hanging mobile or advertising device, these changes being due to atmospherical conditions, such as moisture, temperature or the like, or to the material wear and tear and loss of elasticity.

SUMMARY OF THE INVENTION

The device of the present invention eliminates all of these inconveniences. The device consists of a little plate provided on its rear side with an initially duly protected adhesive layer, in order to allow the fitting of the device by means of digital pressure to the ceiling from which the advertising mobile is designed to hang. The plate is provided on its observe with two perpendicular parallel wings which tend to approach each other, with respective holes in which a shaft is mounted. The shaft is formed as a cylinder, and is provided with extremal stems by means of which the shaft is mounted in the holes. The shaft carries large heads or dishes in the form of disks preceding those stems and designed to bear with their outer faces against the inner face of the respective wing for frictional engagement therewith. This effect, in particular cases (specifically for mobiles with a weight of more than 300 g) can be increased by means of making the said heads or dishes with a corrugated or ribbed surface, and possibly providing the same structure around the holes in which the shaft is designed to be mounted, the latter being provided to bear a winding thread or the like from which the mobile hands and that will stay with the useful length designed as the most suitable for every case, thanks to the braking effect of the wings upon the shaft of the device.

BRIEF DESCRIPTION OF THE DRAWING

The sole FIGURE of the drawing is a front perspective view of the device, the mobile or handing advertising element being omitted.

SPECIFIC DESCRIPTION

According to the drawing, the device subject matter of the invention is constituted by a little plate 1, designed to adapt by its rear side to the concerned ceiling, provided to this end with known means, such as a pressure-applicable adhesive layer 2 applied by pressure initially marked by a suitable removable protective sheet.

On its obverse the plate 1, designed to be secured to the ceiling, is provided with two wings 3, perpendicular and parallel to each other, though with a significant resilient tendency (indicated by the arrows) to approach the other.

A hole 4 is formed on each of the wings 3, this hole being designed to allow the mounting under pressure of the corresponding stem 5 in which abuts each of the extremes of the shaft 6, that as a cylinder bears a winding thread or the like 7, from which hangs the mobile (not shown).

The same shaft 6 is provided with the heads 8 of relative great diameter, that receive the elastic pressure of the wings 3, sufficient to immobilize said shaft and the winding thread 7, counteracting in this way the weight of the hanging mobile.

In particular cases (specifically for mobiles with a weight exceeding from 300 g), the braking effect of the wings 3 upon the shaft 6 can be increased by corrugations or ribs 9 on the outer face of the heads or dishes 8 and/or around the holes 5, on the inner face of the wings 3.

In several cases a spring or returning mean of the shaft 6, would be incorporated, as well as other suitable means to increase the counterbalancing capacity of the device with respect to the weight of the mobile, but in general the described structure is sufficient to obtain good results.

I claim:

1. A device for suspending a mobile at a selected but fixed distance from a ceiling, consisting of:

a plate having a reverse side and an obverse side;

a pressure adhesive on said reverse side for adhering said plate to a ceiling;

a pair of wings projecting from said front side and resiliently biased toward one another, each of said wings being formed with a hole and with an inwardly facing surface surrounding said hole;

a shaft received between said wings and formed with respective stems received in said holes;

respective disks carried by said shaft adjacent said stems and in contact with said surfaces, said wings resiliently pressing said surfaces against said disks; and a coil of a mobile-suspending strand wound on said shaft and retained against being drawn from said shaft by the resilient pressing of said surfaces against the respective disks.

2. The device defined in claim 1 wherein said surfaces and the respective disks are formed with mutually engaging corrugations.

* * * * *